US006337598B1

(12) United States Patent
Ohno

(10) Patent No.: US 6,337,598 B1
(45) Date of Patent: Jan. 8, 2002

(54) REFERENCE VOLTAGE GENERATING DEVICE AND GENERATING METHOD OF THE SAME

(75) Inventor: Kazuki Ohno, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/515,543

(22) Filed: Feb. 29, 2000

(30) Foreign Application Priority Data

Mar. 2, 1999 (JP) ..... 11-054615

(51) Int. Cl.[7] ..... G05F 1/10
(52) U.S. Cl. ..... 327/540; 327/547; 327/548
(58) Field of Search ..... 323/265, 268, 323/271, 272, 282; 327/531, 536, 540, 541, 544, 547, 548

(56) References Cited

U.S. PATENT DOCUMENTS 4,868,908 A * 9/1989 Pless et al. ..... 323/267
5,739,712 A * 4/1998 Fujii ..... 327/323
5,754,417 A * 5/1998 Nicollini ..... 363/60
5,852,359 A * 12/1998 Callahan, Jr. et al. ..... 323/274
5,994,950 A * 11/1999 Ochi ..... 327/543

FOREIGN PATENT DOCUMENTS

JP 7-334256 12/1995
JP 9-288897 11/1997

* cited by examiner

*Primary Examiner*—Jeffrey Zweizig
(74) *Attorney, Agent, or Firm*—Sughrue Mion, PLLC

(57) ABSTRACT

A reference voltage generating device and method enables dissipation current to be reduced at the time of normal operation. An oscillator outputs a voltage of a low level intermittently during a prescribed time interval. An operational amplifier operates only when an output voltage of the oscillator is a low level. When the output voltage of the oscillator is a high level, a reference voltage "VREF" becomes a floating state so that a level is maintained by compensating the capacity of a capacitor C1. The reference voltage "VREF," whose electric charge leaks due to a leak at the junction of a transistor, is maintained while operating the operational amplifier during a time interval T in a time period 10 T.

8 Claims, 3 Drawing Sheets

REFERENCE VOLTAGE GENERATING DEVICE AND GENERATING METHOD OF THE SAME

BACKGROUND OF THE INVENTION

The present invention relates to a reference voltage generating device and a method for reducing dissipation current in the normal operation.

DESCRIPTION OF THE PRIOR ART

In the conventional technique, a reference voltage generating device shown FIG. 1 is well known. Such reference voltage generating device has an operational amplifier 101, resistors R11, R12 for determining value of a feedback voltage which is supplied to the operational amplifier 101, and a capacitor C10 for the sake that it causes the reference voltage to be stabilized, which reference voltage is an output voltage of the operational amplifier.

The operational amplifier 101 inputs therein an external reference voltage 'VREFO'. The external reference voltage is generated in such a way that difference of threshold value voltage between two different kinds of transistors, or the like. Thus, difference of threshold value voltage of two kinds of transistors is utilized for the sake of the external reference voltage. The external reference voltage is an external voltage which is generated while utilizing difference of threshold value voltage of two kinds of different transistors, therefore, the external reference voltage 'VREFO' is a fixed voltage independent on temperature or so forth. The reference voltage generating device outputs a reference voltage 'VREF'. The 'VREF' denotes reference voltage. Relationship between the external reference voltage 'VREFO' and the reference voltage 'VREF' as being an output voltage of the reference voltage generating device is VREF=VREFO×(R11+R12)/R12. Such reference voltage 'VREF' becomes for instance, a standard of internal power-supply voltage.

Further, as the conventional technique, the official report of the Japanese Patent Application Laid-Open No. HEI 9-288897 discloses this kind of "Reference Voltage Generating Device". The "Reference Voltage Generating Device" disclosed in the official report of the Japanese Patent Application Laid-Open No. HEI 9-288897 includes an operation signal generator which generates a pump enable signal to control operation of an oscillator, a comparator, and a reference voltage generator. At the time of normal operation, the operation signal generator generates an active pump enable signal to operate a voltage supply circuit. Thus, the voltage supply circuit generates voltage in answer to the reference voltage generated according to the reference voltage generator. At the time of standby, a CPU outputs an internal clock signal. The operation signal generator generates the active pump enable signal during a prescribed time interval from a leading edge of the clock signal according to such the internal clock signal from the CPU. The reference voltage generating device causes the voltage supply circuit to be operated intermittently in order to supply voltage.

However, in the conventional reference voltage generating device shown in FIG. 1, the reference voltage 'VREF' is normally inputted to a gate of a transistor. Thus, the gate of the transistor does not consume current. However, there is the problem that the dissipation current becomes large. In the above construction, the terminal of the reference voltage "VREF" is connected to ground through the resistors R11, R12, so that the operational amplifier 101 always should supply electric charge from the operational amplifier 101. Furthermore, the operational amplifier 101 itself consumes current, thus dissipation current becomes large.

Moreover, in the reference voltage generating device disclosed in the official report of the Japanese Patent Application Laid-Open No. HEI 9-288897, the reference voltage generating device causes the voltage supply circuit to be operated intermittently only at the time of standby. While at the time of normal operation, the reference voltage generating device causes the voltage supply circuit not to operate intermittently, therefore, there is the problem that the dissipation current becomes large.

SUMMARY OF THE INVENTION

In view of the foregoing, it is an object of the present invention, in order to overcome the above mentioned problems, to provide a reference voltage generating device and generating method of the same which enables consumption current to be reduced at the time of normal operation.

According to a first aspect of the present invention, in order to achieve the above mentioned object, there is provided a reference voltage generating device which is provided with an operational amplifier which comprises an intermittent operating means for operating the operational amplifier intermittently only during a prescribed time interval.

According to a second aspect of the present invention, in the first aspect, there is provided a reference voltage generating device, wherein the intermittent operating means comprises by an oscillator.

According to a third aspect of the present invention, there is provided a reference voltage generating device which comprises an operational amplifier which has an enable terminal, two resistors for determining a feedback voltage which is supplied to the operational amplifier, a transistor for deciding whether or not a route of the feedback voltage to be disconnected occurs, a capacitor for stabilizing reference voltage, which is an output voltage of the operational amplifier, and an intermittent operating means for providing a drive voltage in order to operate the operational amplifier intermittently, which intermittent operating means is provided at the enable terminal of the operational amplifier.

According to a fourth aspect of the present invention, in the third aspect, there is provided a reference voltage generating device, wherein the intermittent operating means comprises an oscillator.

According to a fifth aspect of the present invention, there is provided a reference voltage generating method of a reference voltage generating device provided with an operational amplifier which comprises the step of operating the operational amplifier intermittently only during a prescribed time interval by means of intermittent operating means.

According to a sixth aspect of the present invention, there is provided a reference voltage generating method of a reference voltage generating device provided with an operational amplifier which comprises the step of operating the operational amplifier intermittently only during a prescribed time interval by means of an oscillator.

According to a seventh aspect of the present invention, there is provided a reference voltage generating method of a reference voltage generating device which is provided with an operational amplifier which has an enable terminal, two resistors for determining a feedback voltage which is supplied to the operational amplifier, a transistor for deciding whether or not a route of the feedback voltage to be disconnected occurs, and a capacitor for stabilizing a reference voltage which is an output voltage of the operational amplifier, which comprises the step of providing a drive voltage in order to operate the operational amplifier intermittently by intermittent operating means provided at an enable terminal of the operational amplifier.

According to an eighth aspect of the present invention, there is provided a reference voltage generating method of a reference voltage generating device which is provided with an operational amplifier which has an enable terminal, two resistors for determining a feedback voltage which is supplied to the operational amplifier, a transistor for deciding whether or not a route of the feedback voltage to be disconnected occurs, and a capacitor for stabilizing a reference voltage which is an output voltage of the operational amplifier, which comprises the step of providing a drive voltage in order to operate the operational amplifier intermittently by an oscillator provided at an enable terminal of the operational amplifier.

The above and further objects and novel features of the invention will be more fully understood from the following detailed description when the same is read in connection with the accompanying drawings. It should be expressly understood, however, that the drawings are for purpose of illustration only and are not intended as a definition of the limits of the invention.

DETAILED DESCRIPTION OF THE PREFERRED EMBODIMENTS

A preferred embodiment of the present invention will now be described in detail in accordance with the accompanying drawings.

Figure 1:
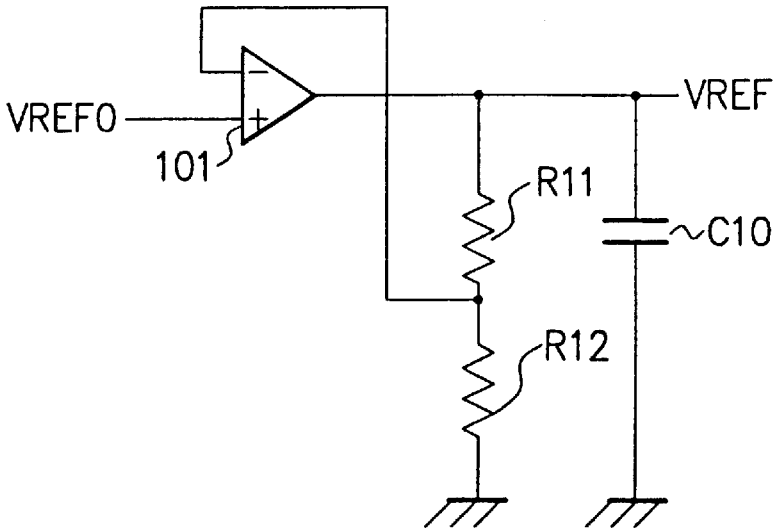
FIG. 1 PRIOR ART
FIG. 1 is an electric circuit view showing a conventional reference voltage generating device.
Figure 2:
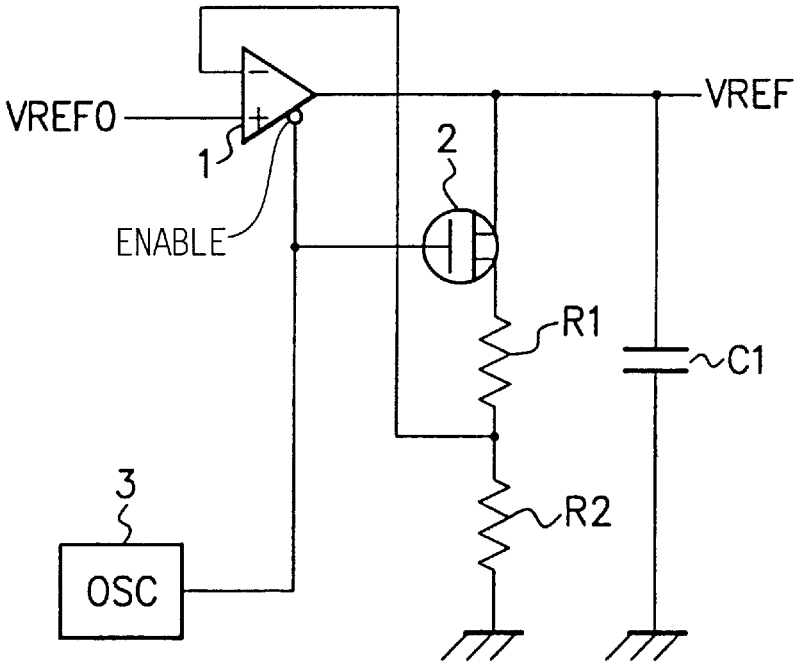
FIG. 2 is an electric circuit view showing a reference voltage generating device as a first embodiment of the present invention.

FIG. 2 is an electric circuit view showing a reference voltage generating device as a first embodiment of the present invention. As shown in FIG. 2, the reference voltage generating device comprises an operational amplifier 1, two resistors R1 and R2, a P-channel transistor 2, a capacitor C1, and an oscillator 3. The operational amplifier 1 inputs therein an external reference voltage "VREFO". The operational amplifier 1 outputs a reference voltage "VREF".

The operational amplifier 1 has an output terminal. A drain electrode of the transistor 2 is connected to the output terminal of the operational amplifier 1. The resistors R1 and R2 are connected in series between a source electrode of the transistor 2 and the ground. The oscillator 3 has an output terminal. The output terminal of the oscillator 3 is connected to a gate electrode of the transistor 2. Furthermore, the output terminal of the oscillator 3 is connected to an enable terminal of the operational amplifier 1. The resistors R1 and R2 are used for determining a value of the feedback voltage which is supplied to the operational amplifier 1. A connecting point between the resistor R1 and the resistor R2 is connected to the operational amplifier 1. The capacitor C1 is connected between the output terminal of the operational amplifier 1 and ground. Capacitor C1 is used for stabilizing the reference voltage VREF, which is an output voltage of the operational amplifier 1.

Figure 3:
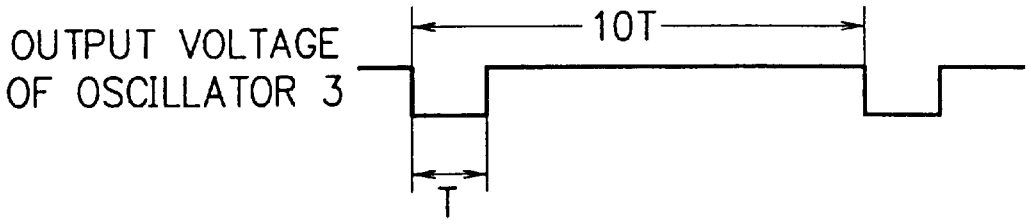
FIG. 3 is view for explaining output voltage of an oscillator of the reference voltage generating device of FIG. 2.

As shown in FIG. 3, the output voltage of the oscillator consists of a low level voltage and a high level voltage. The low level voltage continues for a consecutive T times interval. The high level voltage continues for a consecutive 9 T times interval. The oscillator 3 outputs the low level voltage of the T times interval and the high level voltage of the 9 T times interval during 1 period. Namely, the oscillator 3 outputs a voltage of the low level intermittently during a prescribed time interval. The operational amplifier 1 operates (is activated) only during the time when an output voltage of the oscillator 3 is a low level. When the output voltage of the oscillator 3 is a low level, it causes the transistor 2 to conduct. Hence, the transistor 2 becomes a conducting state during the time interval when the output voltage of the oscillator 3 is a low level. Namely, as the output voltage of the oscillator 3 is only a low level, it causes the operational amplifier 1 to operate. On the other hand, an output voltage of the oscillator 3 can be a high level. Thus, the reference voltage "VREF" becomes a floating state. The high level maintained by compensation capacity of the capacitor C1. During this time, the reference voltage generating device becomes the same state as a memory cell of DRAM. With regard to the reference voltage "VREF", electric charge leaks out caused by a leak at a junction of the transistor 2. The operational amplifier 1 operates only one time of the T times interval in the one consecutive period of 10 T (=degree of 10 $\mu$s to 100ms) to maintain a level of the reference voltage "VREF". Needless to say, it is suitable that a consecutive period is not 10 T, but variable. The most suitable value of the consecutive period is obtained according to a quantity of the leak and/or largeness of the capacity of the capacitor C1. There is not a problem that the consecutive period exceeds above the described time interval.

Figure 4:
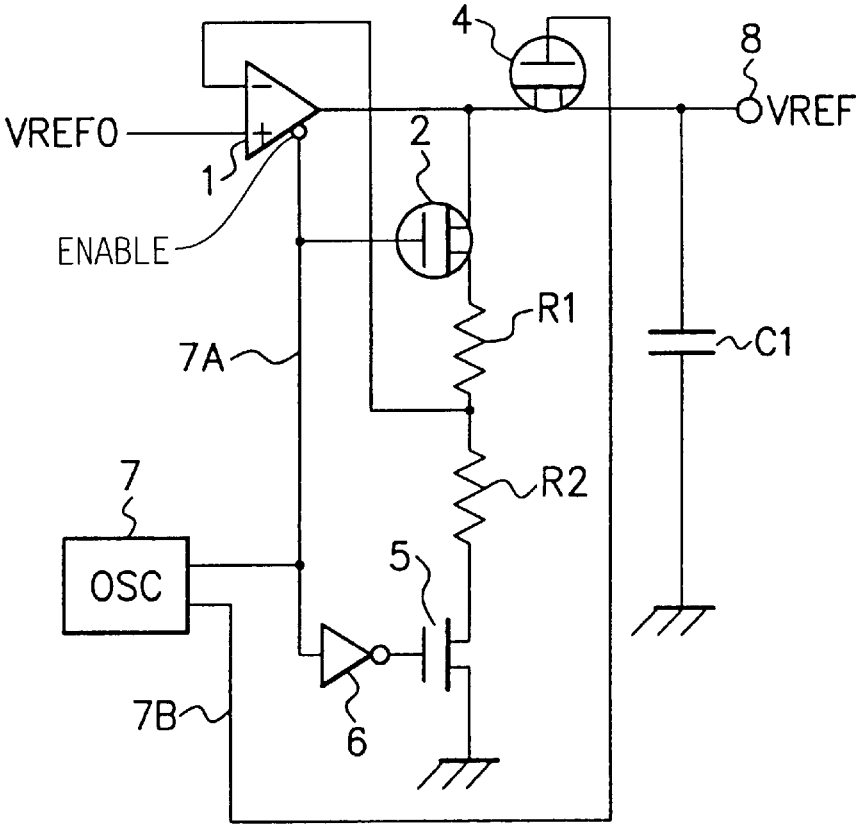
FIG. 4 is an electric circuit view showing the reference voltage generating device as a second embodiment of the present invention.

Next, there will be described a second embodiment of the present invention in detail referring to accompanying drawing. FIG. 4 is an electric circuit view showing the reference voltage generating device as a second embodiment of the present invention. In the second embodiment of the present invention, the same reference numbers as that of the elements of the first embodiment are the same. As shown in FIG. 4, the reference voltage generating device comprises an operational amplifier 1, two resistors R1 and R2, P-channel transistors 2 and 4, N-channel transistor 5, an inverter 6, a capacitor C1, and an oscillator 7. The operational amplifier 1 inputs therein an external reference voltage "VREFO". The operational amplifier 1 outputs the reference voltage "VREF".

A drain electrode of the transistor 2 is connected to an output terminal of the operational amplifier 1. A source electrode of the transistor 2 is connected to the resistor R1. A resistor R2 is connected to the resistor R1 in series. The oscillator 7 has a first output terminal 7A and a second output terminal 7B. The first output terminal 7A of the oscillator 7 is connected to a gate electrode of the second transistor 2. Furthermore, the first output terminal 7A of the oscillator 7 is connected to an enable terminal of the operational amplifier 1. The resistors R1 and R2 are used for determining the value of the feedback voltage which is supplied to the operational amplifier 1. A connecting point between the resistor R1 and the resistor R2 is connected to the operational amplifier 1.

A drain electrode of the transistor 5 is connected to the resistor 2. A source electrode of the transistor 5 is connected to the ground. The first output terminal 7A of the oscillator 7 is connected to the gate electrode of the transistor 5 through the inverter 6. A drain electrode of the transistor 4 is connected to the output terminal of the operational amplifier 1. An output terminal 8 which outputs the reference voltage "VREF" is connected to the transistor 4. Furthermore, the capacitor C1 is connected between a source electrode of the transistor 4 and the ground. The second output terminal 7B of the oscillator 7 is connected to a gate electrode of the transistor 4. The capacitor C1 is used for stabilizing the reference voltage "VREF" which is output voltage of the operational amplifier 1.

Figure 5:
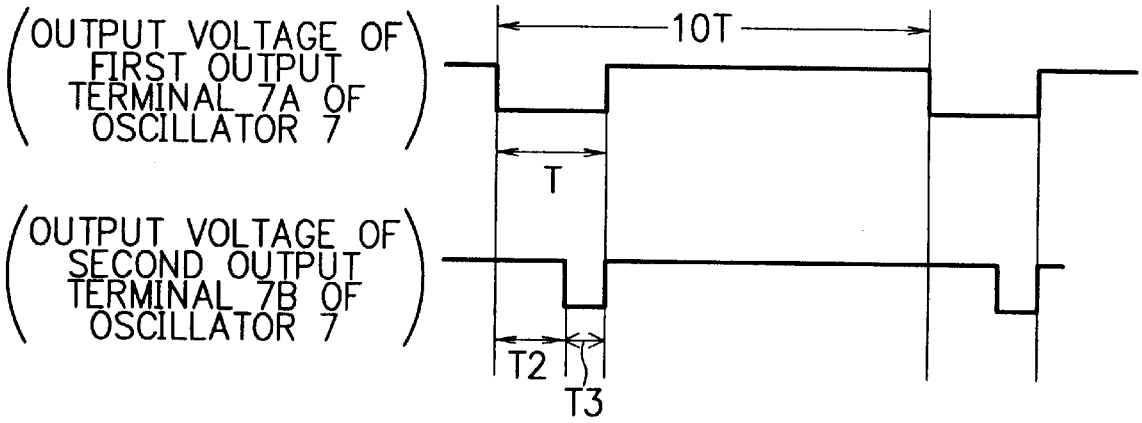
FIG. 5 is a view for explaining output voltage of an oscillator of the reference voltage generating device of FIG. 3.

As shown in FIG. 5, the oscillator 7 outputs a low level voltage of a time interval of T times and a high level voltage of a time interval of 9 T times during 1 consecutive period from the first output terminal 7A. Namely, the oscillator 7 outputs a voltage of the low level intermittently from the first output terminal 7A. According to this operation, the oscillator 7 operates intermittently. Furthermore, the oscillator 7 outputs a low level voltage of the time interval of 3 T times and a high level voltage of the time interval of 9 T times from the second output terminal 7B during the time interval of 1 period. The low level voltage of the time interval of 3 T times is outputted while delaying the time interval of T2 times from the start time point of the low level of the first output terminal 7A. The high level voltage of the time interval of 9 T times follows the low level voltage of the time interval of T3 times.

Figure 6:
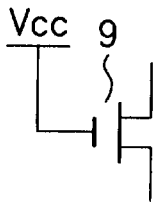
FIG. 6 is an electric circuit view showing a part of the reference voltage generating circuit as an another embodiment of the present invention.

In the first embodiment of the present invention, when the transistor is turned ON, the reference voltage "VREF" becomes the state such that there is a short circuit between the reference voltage "VREF" and the ground level. Thus, the reference voltage "VREF" decreases slightly. Accordingly, there is provided the transistor 4 in the second embodiment of the present invention. It causes the transistor 4 to be turned ON with a delay of the time interval of T2 times from the start time point of the low level voltage of the first output terminal 7A, in such the time interval of T2 times from the start time point of the low level voltage, divided voltage of the resistor R1, is stabilized. Namely, the divided voltage of the resistor R1 is stabilized at the time point of the starting of the low level of the first output terminal 7A. Furthermore, the transistor 5 prevents that level of the connecting point between the resistor R1 and the resistor R2 for supplying feedback voltage and becomes ground level. The transistor 5 is added to quickly stabilize the divided voltage of the resistor R1. The time T is a necessary time when the reference voltage "VREF" becomes a prescribed electric potential. Moreover, it is suitable that the resistors R1 and R2 consist of a poly-silicone layer resistor or an ON-resistor of the transistor. In such the case, as shown in FIG. 6, it is suitable that it causes prescribed voltage Vcc to be applied to the gate electrode of a transistor 9.

In the above-described embodiment of the present invention the operational amplifier ceases intermittently at a prescribed time interval. Therefore, it is capable of reducing dissipation current. For instance, consider when the dissipation current of the oscillators 3, 7 is taken as 2 $\mu$A, and the dissipation current of the operational amplifier is taken as 10 $\mu$A. When operating period of the operational amplifier 1 is taken as (1/10) T, the total dissipation current becomes $(2+10\times(1/10)=)3\ \mu A$. Consequently, in the above described embodiment, it enables the dissipation current to be reduced approximately 1/3 of the dissipation current of the conventional reference voltage generating device.

As described above, according to the present invention, dissipation current at the time of normal operation can be reduced.

While preferred embodiments of the invention have been described using specific terms, such description is for illustrative purpose only, and it is to be understood that changes and variations may be made without departing from the spirit or scope of the following claims.

What is claimed is:

1. A reference voltage generating device, comprising:

an operational amplifier having an enable terminal; and an intermittent operating means, provided at said enable terminal, for operating said operational amplifier intermittently only during a prescribed time interval.

2. A reference voltage generating device as claimed in claim 1, wherein said intermittent operating means comprises an oscillator.

3. A reference voltage generating device, comprising:

an operational amplifier which has an enable terminal;

two resistors for determining a feedback voltage which is supplied to said operational amplifier;

a transistor for deciding whether or not a route of said feedback voltage to be disconnected occurs;

a capacitor for stabilizing a reference voltage which is an output voltage of said operational amplifier; and an intermittent operating means for providing a drive voltage in order to operate said operational amplifier intermittently, wherein said intermittent operating means is provided at said enable terminal of said operational amplifier.

4. A reference voltage generating device as claimed in claim 3, wherein said intermittent operating means comprises an oscillator.

5. A reference voltage generating method that comprises an operational amplifier having an enable terminal, said method comprising the step of:

operating said operational amplifier intermittently only during a prescribed time interval by means of an intermittent operating means, wherein said intermittent operating means is provided at said enable terminal.

6. A reference voltage generating method that comprises an operational amplifier having an enable terminal, said method comprising the step of:

operating said operational amplifier intermittently only during a prescribed time interval by means of an oscillator, wherein said intermittent operating means is provided at said enable terminal.

7. A reference voltage generating method that comprises an operational amplifier which has an enable terminal, two resistors for determining a feedback voltage which is supplied to said operational amplifier, a transistor for deciding whether or not a route of said feedback voltage to be disconnected occurs, and a capacitor for stabilizing a reference voltage which is an output voltage of said operational amplifier, said method comprising the step of:

providing a drive voltage in order to operate said operational amplifier intermittently by an intermittent operating means provided at an enable terminal of said operational amplifier.

8. A reference voltage generating method that comprises an operational amplifier which has an enable terminal, two resistors for determining a feedback voltage which is supplied to said operational amplifier, a transistor for deciding whether or not a route of said feedback voltage to be disconnected occurs, and a capacitor for stabilizing a reference voltage which is an output voltage of said operational amplifier, said method comprising the step of:

providing a drive voltage in order to operate said operational amplifier intermittently by an oscillator provided at an enable terminal of said operational amplifier.

* * * * *